US009822518B1

(12) United States Patent
Arriaga et al.

(10) Patent No.: US 9,822,518 B1
(45) Date of Patent: Nov. 21, 2017

(54) RETRACTABLE URINE-SPLASH MITIGATING DEVICE

(71) Applicants: Jim Arriaga, Whittier, CA (US); Edward Yang, Issaquah, WA (US)

(72) Inventors: Jim Arriaga, Whittier, CA (US); Edward Yang, Issaquah, WA (US)

( * ) Notice: Subject to any disclaimer, the term of this patent is extended or adjusted under 35 U.S.C. 154(b) by 0 days.

(21) Appl. No.: 15/160,792

(22) Filed: May 20, 2016

(51) Int. Cl.
*E03D 9/00* (2006.01)
*E03D 11/02* (2006.01)

(52) U.S. Cl.
CPC ..... *E03D 9/00* (2013.01); *E03D 11/02* (2013.01)

(58) Field of Classification Search
CPC ..... E03D 9/00; E03D 11/02
USPC ..... 4/300.3
See application file for complete search history.

(56) References Cited

U.S. PATENT DOCUMENTS 5,216,760 A * 6/1993 Brown ..... A47K 13/08 4/300.3
2009/0211007 A1 8/2009 Partridge
2015/0047114 A1 2/2015 Ramirez
2015/0143624 A1 5/2015 Irving
2015/0211221 A1 7/2015 Tarabay

OTHER PUBLICATIONS

Hurd, R. et al, "Creating a urine black hole," Symposium, Nov. 22, 2015-Nov. 24, 2015, Boston, MA. Retrieved from the Internet: <URL: http://meetings.aps.org/link/BAPS.2015.DFD.M32.10>.

* cited by examiner

*Primary Examiner* — Tuan N Nguyen

(57) ABSTRACT

Described herein is an apparatus mitigating splash-back during the use of a conventional toilet while urinating. The apparatus uses a plurality of upstanding baffles that provide for a large target area mounted on a base with a central opening. Additionally, the baffles rotate into and out of operative configurations, relative to the inner-toilet surface, to allow the use of the toilet for solid waste. The baffles mitigate the effect of splash back as the urine stream makes contact with the baffles and reflects the droplets laterally. Additionally, droplets generated when the urine stream contacts either the base or pool of standing water is mitigated by the baffles intercepting the reflective path back to the user.

16 Claims, 11 Drawing Sheets

RETRACTABLE URINE-SPLASH MITIGATING DEVICE

BACKGROUND

Field of the Technology

The present invention relates generally to toilet sanitation. In particular, the invention relates to anti-splash devices for conventional toilets in CPC E03D 9/00, sanitary or other accessories for lavatories, and CPC A47K 13/26, mounting devices for seats or covers.

Conventional floor toilets, typically constructed of porcelain or a similar material, are a receptacle having a floor-mounted, bowl-shaped collection basin with a pool of standing water in the basin. A drain is typically placed at the bottom of the basin below the pool of standing water. The interior walls of the basin and the standing water provide an area to receive a stream of urine from a person using the toilet. When the toilet is flushed, water runs down and along the interior walls and the standing water, along with the urine, exits through the drain. Fresh water then replaces the flushed fluids to create another pool of standing water for future use.

The porcelain construction of toilets means that it has hard-surfaced walls. These hard surfaces reflect or deflect some portion of any urine stream directed thereon, splashing droplets of urine away from the point where the urine stream impacts the surface. Further, a urine stream directed into the standing pool of water in the basin will also cause splashing, in this case in the form of a urine-water mixture.

This splash back is a long-recognized problem and can occur regardless of whether the urine stream first contacts the surface of the water or the interior wall of the collection basin.

Several functional solutions to the problem of splash back in conventional toilets have been attempted. Past solutions suffer from having either small targets making use of the solution difficult or prevent the use of the toilet for solid waste making the solution inconvenient. Accordingly, there is a continuing need for an alternative conventional-toilet splash-back device that is convenient, effective, and practical.

BRIEF SUMMARY

The illustrated embodiments of the invention include an apparatus for attenuating reflective splash during the use of a conventional toilet. The apparatus includes a base that includes a plurality of upstanding, retractable baffles. The base, lying against the interior surface of the basin, has an appropriate thickness so that the flow of water down the interior walls of the basin during the flushing process is unobstructed. Additionally, the base, made of a flexible sheet material which is wrapped into a frustoconical form and laid on the interior surface of the toilet bowl, has perforations defined therethrough to prevent the collection of fluid on the surface of the base while still conforming to the contours of the interior surface of the basin. A central opening, defined by the base, exposes the pool of standing water below it and allows for, in addition to the retractable baffles, the operation of the toilet for solid waste without the need to remove the apparatus. The conical shape of the base prevents the base from sliding down into the lower portion of the basin. Rails run along both the upper and lower edges of the base providing rigidity and structure to the base.

In some embodiments, the base does not use the rails along both upper and lower edges. This allows the base to maintain a flexible property and adapt to different toilet-bowl shapes.

In some embodiments, the base has a radial cut through the entirely of the thickness of the base, breaking the continuity of the base, to allow for temporary manipulation of the shape of the base to ease the installation process into the toilet.

In some embodiments, the base is suspended by hooks that attach to the rim of the toilet bowl while continuing to keep the base in close contact with the interior surface of the basin.

In accordance with the present invention, a plurality of hinges are disposed radially on the base. The hinges would rotate such that the baffles, in the non-operative configuration, would lie parallel to the surface of the base or the rails on the upper and lower edges of the base.

In some embodiments, the hinges are disposed in a radial fashion, but offset such that the hinges form a pinwheel-like pattern, or configuration, on the base.

In some embodiments, the hinges are disposed to form concentric circles where the hinges would rotate toward the central opening.

Also in accordance with the present invention, a plurality of upstanding baffles are disposed on top of the plurality of hinges. When the hinges rotate downward, the baffles are placed into a non-operational configuration and when the hinges rotate upward, the baffles are placed into an operational configuration. The plurality of baffles are substantially uniform or approximately equal in height, thickness, and flexibility.

In accordance with some embodiments, the baffles vary in length with a range of approximately 1 inch to 5 inches, thickness with a range of approximately 0.05 inches to 0.25 inches, and distance between baffles within a group of baffles.

In accordance with some embodiments, the distance between one group of baffles and another, has a range of approximately 0.25 inches to 1 inch so that the operation of the hinges do not cause interference with adjacent baffles.

In some embodiments, where the hinges are disposed in concentric circles, the hinges would vary in height with the taller hinges disposed on top of the base closer to the outer edge of the base and the shorter hinges disposed on top of the base closer to the inner edge of the base.

Also in accordance with the present invention, a plurality of stoppers are disposed adjacent to the plurality of hinges such that the stoppers and hinges are paired together. The stopper prevents the hinge from rotating beyond 90 degrees.

Also in accordance with the present invention, a plurality of rods are disposed within the hinges such that a single rod is disposed within a single hinge. The rod is disposed within the hinge such that the length of the rod runs along the length of the hinge. The exposed end of the rod, facing the outer edge of the base, has an eyelet.

Also in accordance with the present invention, a cable is threaded through each eyelet and secured to each eyelet. When the cable is pulled in one direction, the hinges will rotate and position the baffles in a non-operative configuration. When the cable is pulled in an opposing direction, the hinges rotate oppositely and position the baffles in an operative configuration. The operative configuration includes a configuration where the plurality of baffles are rotated from an angular orientation lying flatly along the interior surface of the toilet to an angular orientation elevated above the inner toilet surface. The intended or preferred fully operative configuration is that one where the plurality of baffles are rotated to an angular orientation wherein they extend generally radially into the central opening of the toilet, but any orientation bringing the baffles out of they flat disposition against the inner surface of the toilet will be operative to a degree.

Also in accordance with the present invention, a spring is attached to one end of the cable. The cable, affixed to the base, provides constant tension such that the baffles are normally disposed into a non-operative configuration.

Also in accordance with the present invention, overcoming the tension in the spring pulls the cable so that the baffles rotate into an operative configuration.

In accordance with some embodiments of the present invention, the cable is attached to the toilet seat. When the toilet seat is lifted, the cable is pulled overcoming the tension of the spring and rotating the baffles into the operative configuration. When the toilet seat is lowered, the baffles rotate into the non-operative configuration.

In accordance with some embodiments of the present invention, the trigger mechanism is a foot pedal disposed on the floor adjacent to the toilet. When the pedal is depressed and locked, the cabled is pulled and the baffles rotate into the operative configuration. When the pedal is released, the baffles rotate back into the non-operative configuration.

While the apparatus and method has or will be described for the sake of grammatical fluidity with functional explanations, it is to be expressly understood that the claims, unless expressly formulated under 35 U.S.C. §112, are not to be construed as necessarily limited in any way by the construction of "means" or "steps" limitations, but are to be accorded the full scope of the meaning and equivalents, and in the case where the claims are expressly formulated under 35 U.S.C. §112 are to be accorded full statutory equivalents under 35 U.S.C. §112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
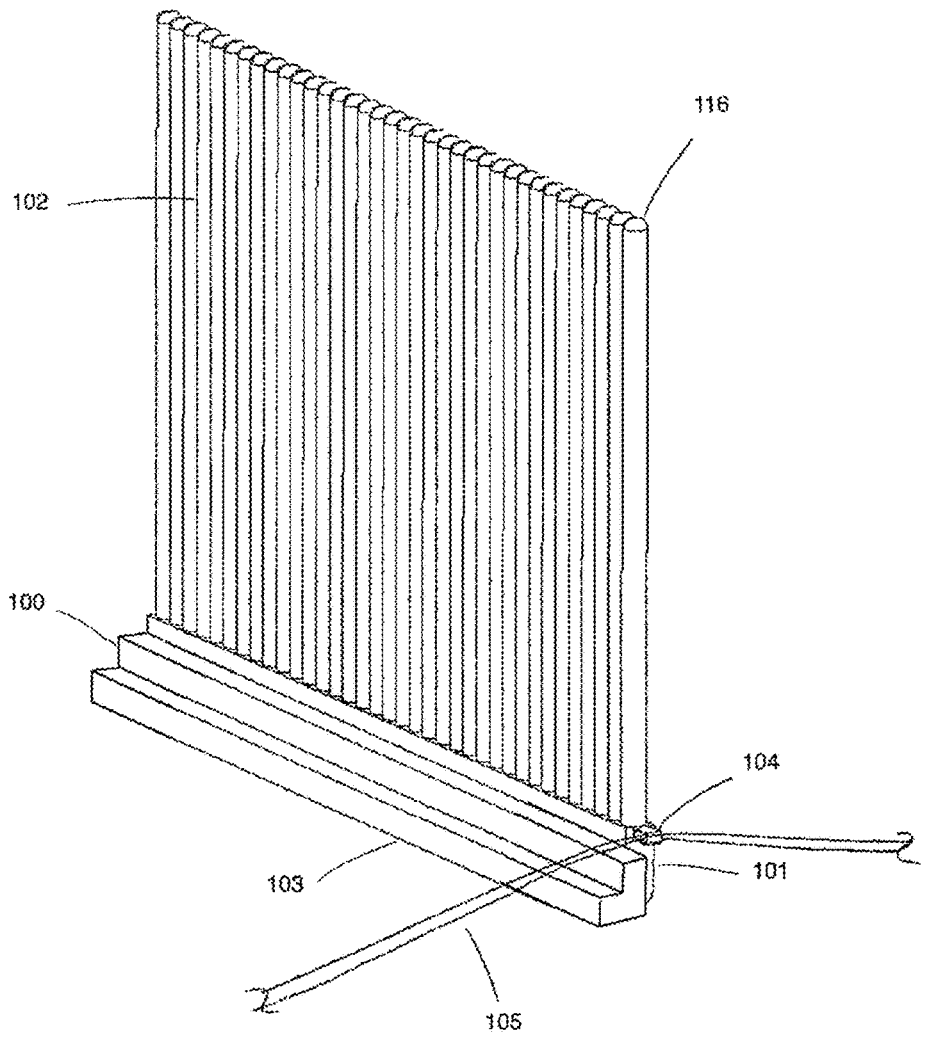
FIG. 1 is an isometric view of a single hinge with the baffles coupled to the hinge in the operative configuration.
Figure 2:
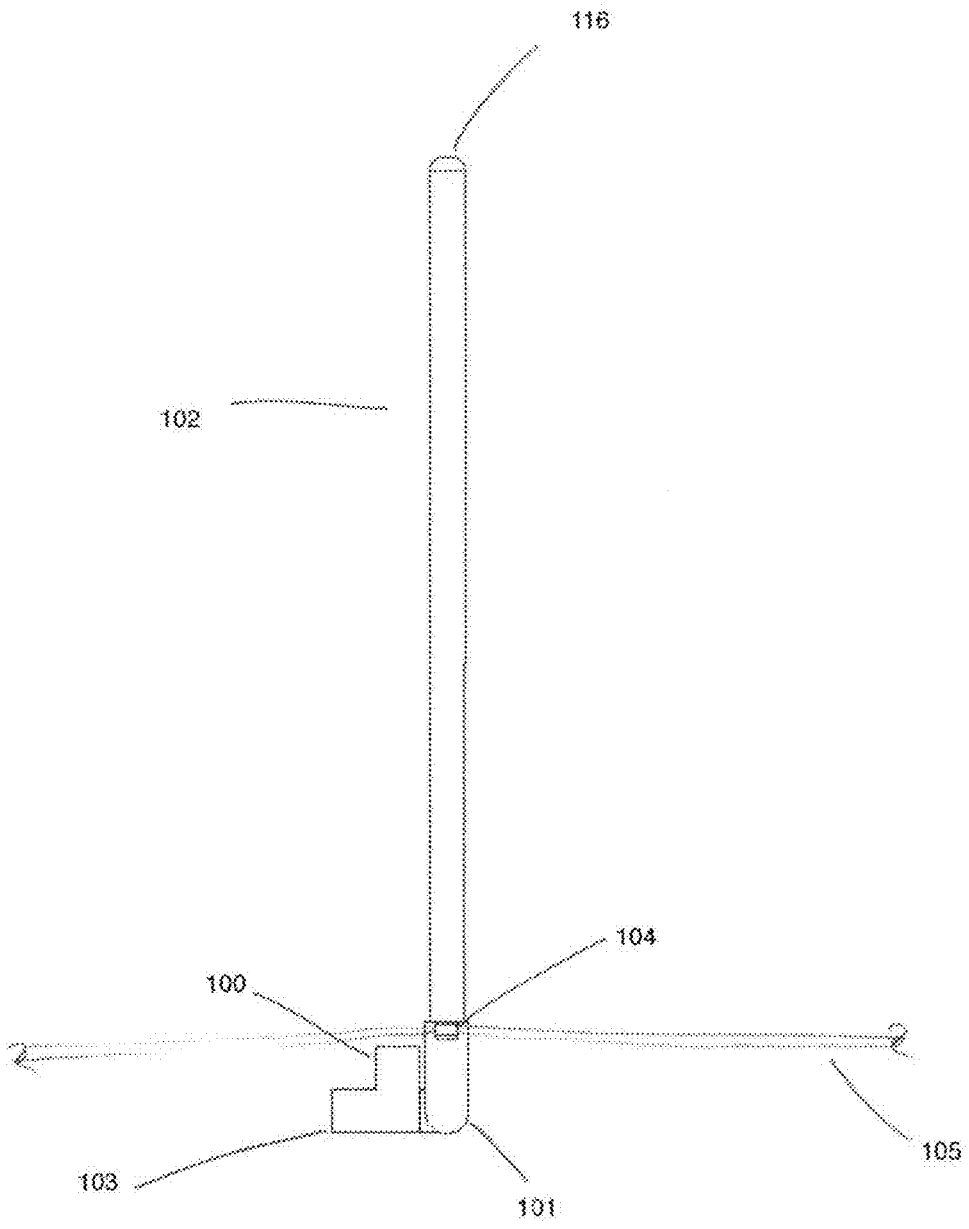
FIG. 2 is a side plan view of a single hinge with the baffles in the operative configuration
Figure 3:
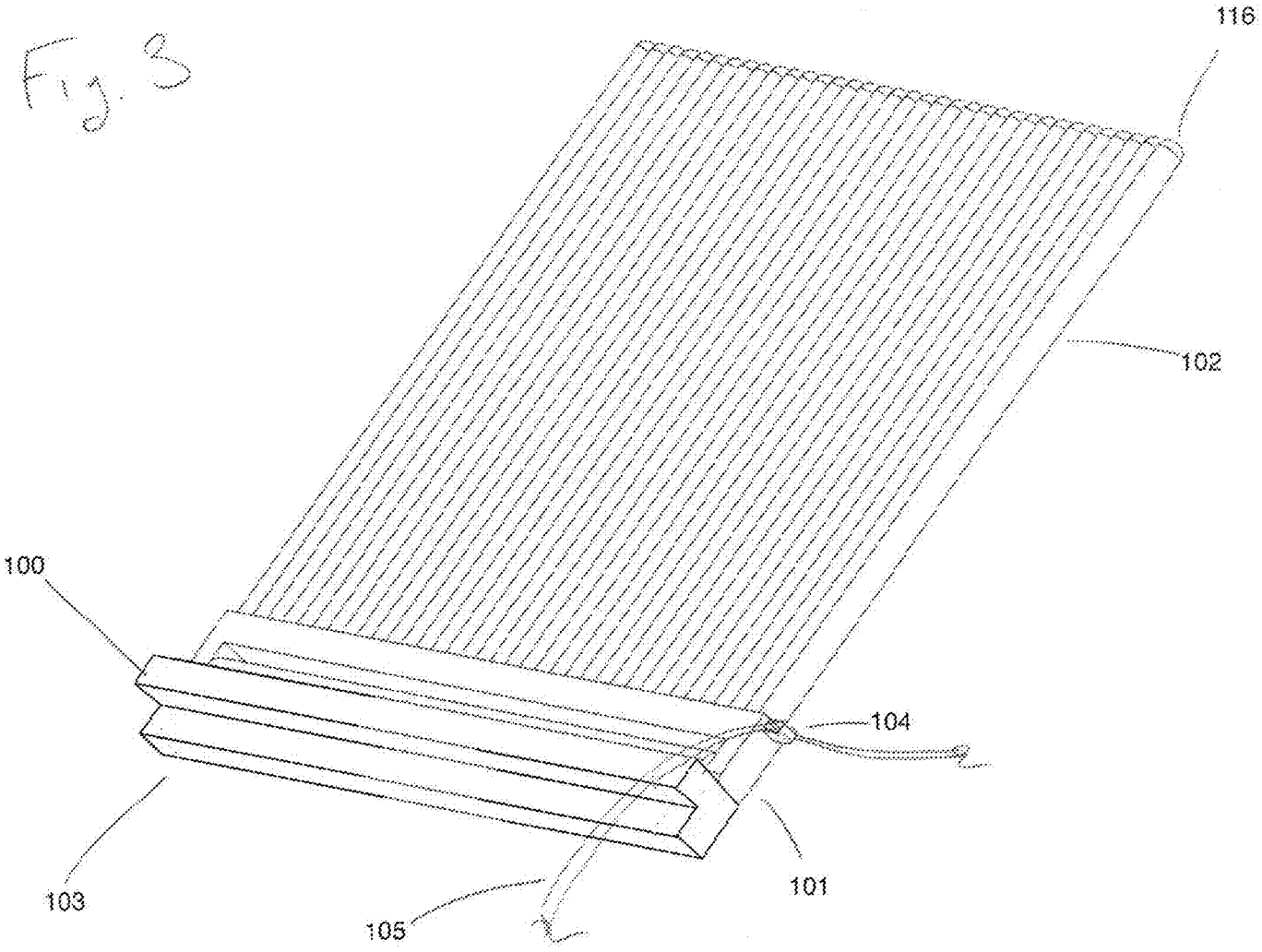
FIG. 3 is an isometric view of a single hinge with the baffles in the non-operative configuration.

FIG. 1 illustrates an aspect of one embodiment. Hinge 101 is a rotatable bar from which a plurality of finger-like baffles 102 extend. Baffles 102 may be integral with hinge 101 or each separately connected or attached to hinge 101. Hinge 101 is rotatable clockwise in FIG. 1 to dispose baffles 102 in a non-operative configuration shown in FIG. 3 and is rotatable counter-clockwise in FIG. 1 to dispose baffles 102 in an operative configuration, which is the configuration shown in FIG. 1. Hinge 101 may include a rod (not shown) along its length that acts as an axle, adjacent and parallel to stopper 103. Alternatively, hinge 101 could rotate on a pin (not shown) extending from each end of the stopper 103. Stopper 103 is a bar with vertically extending flange 100 against which hinge 101 rotates and which serves to stop further counter-clockwise rotation from that shown in FIG. 1. Stopper 103 prevents hinge 101 from rotating beyond an angular orientation corresponding to the extension of flange 100 as best depicted in the side plan view of FIG. 2. Hinge 101 and stopper 103 are preferably composed a substantially rigid plastic. In one embodiment baffles 102 are disposed on top of hinge 101 through holes (not shown) on top of the hinge 101 and adhered within the hinge 101.

Figure 4:
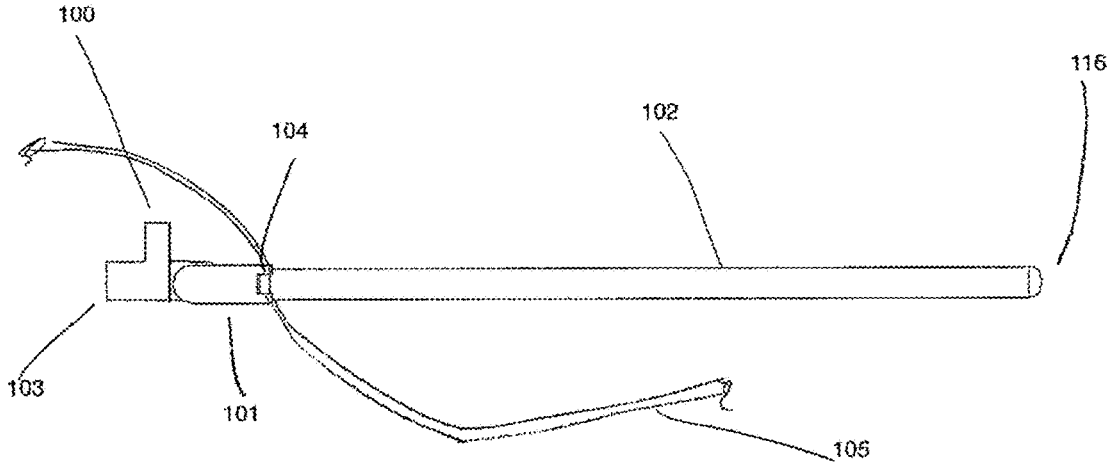
FIG. 4 is a side plan view of a hinge with the baffles in the non-operative configuration.

Eyelet 104 provides a location where a cable 105 may attach. Eyelet 104 is disposed on or extends from an end of hinge 101. The cable 105 rotates hinge 101 in either clockwise or counter-clockwise directions depending on the direction of tension of the cable 105. When the cable 105 pulls from the left in the depiction of FIG. 1, the baffles 102 are disposed in the non-operational configuration shown in FIGS. 3 and 4. Due to the offset of eyelet 104 from the pivot point where hinge 101 is rotatably coupled to stopper 103, the cable 105 pulls from an elevated angle or lever arm relative to the pivot point. This angle allows for the cable 105 to pull the hinge 101 and baffles 102 upward into the operative configuration of FIGS. 1 and 2. When the cable 105 pulls from the right as depicted in FIG. 1, the similar but opposite action occurs to dispose hinge 101 and baffles 102 into the nonoperative configuration of FIGS. 3 and 4. Because the cable 105 is threaded or disposed through a base-mounted eyelet 106 shown in FIG. 5, the cable 105 pulls on hinge 101 from a depressed angle to allow for the cable 105 to pull the hinge 101 and baffles 102 downward.

Figure 5:
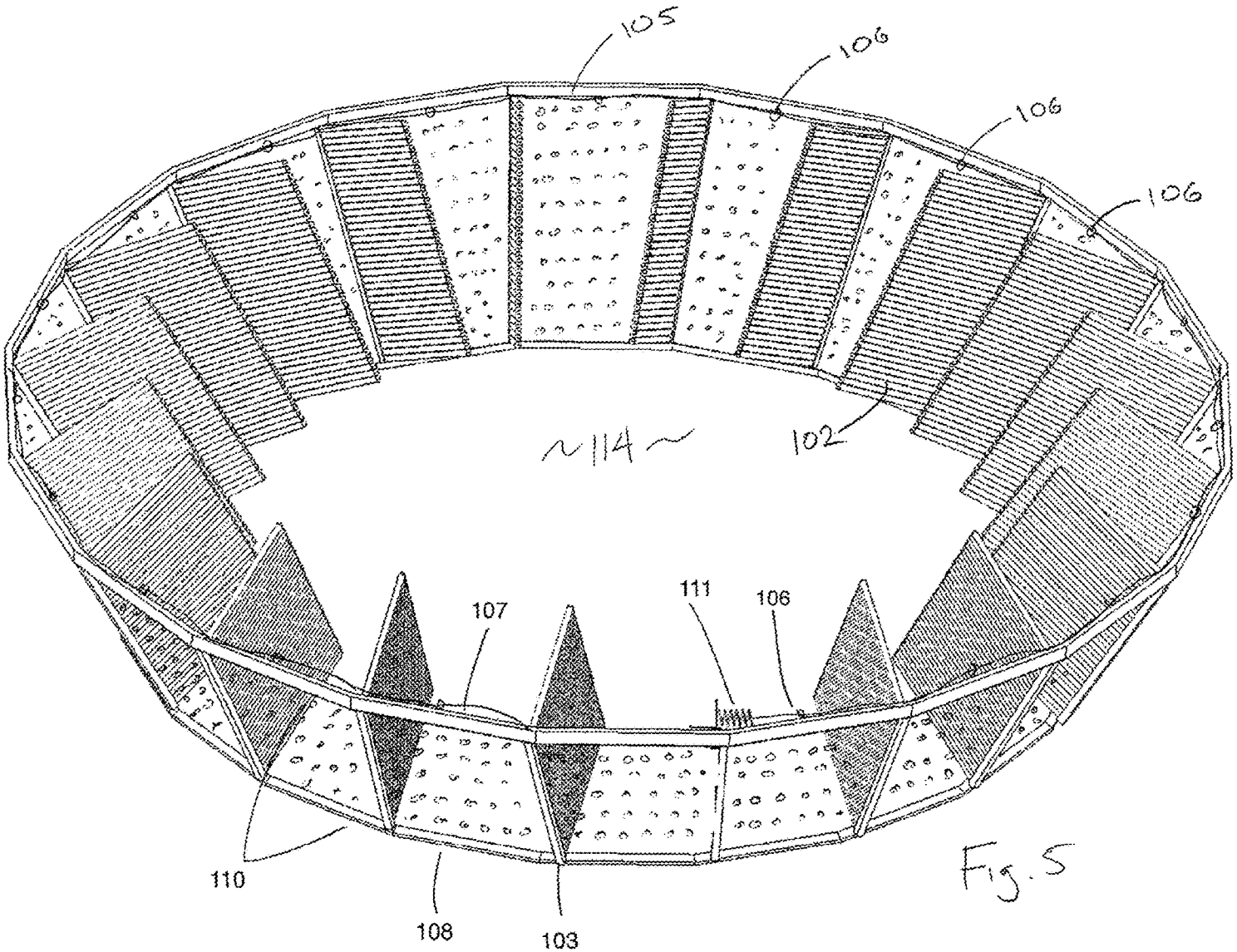
FIG. 5 is top perspective view of the apparatus with a plurality of hinges coupled together with their corresponding baffles disposed in the operative configuration.
Figure 6:
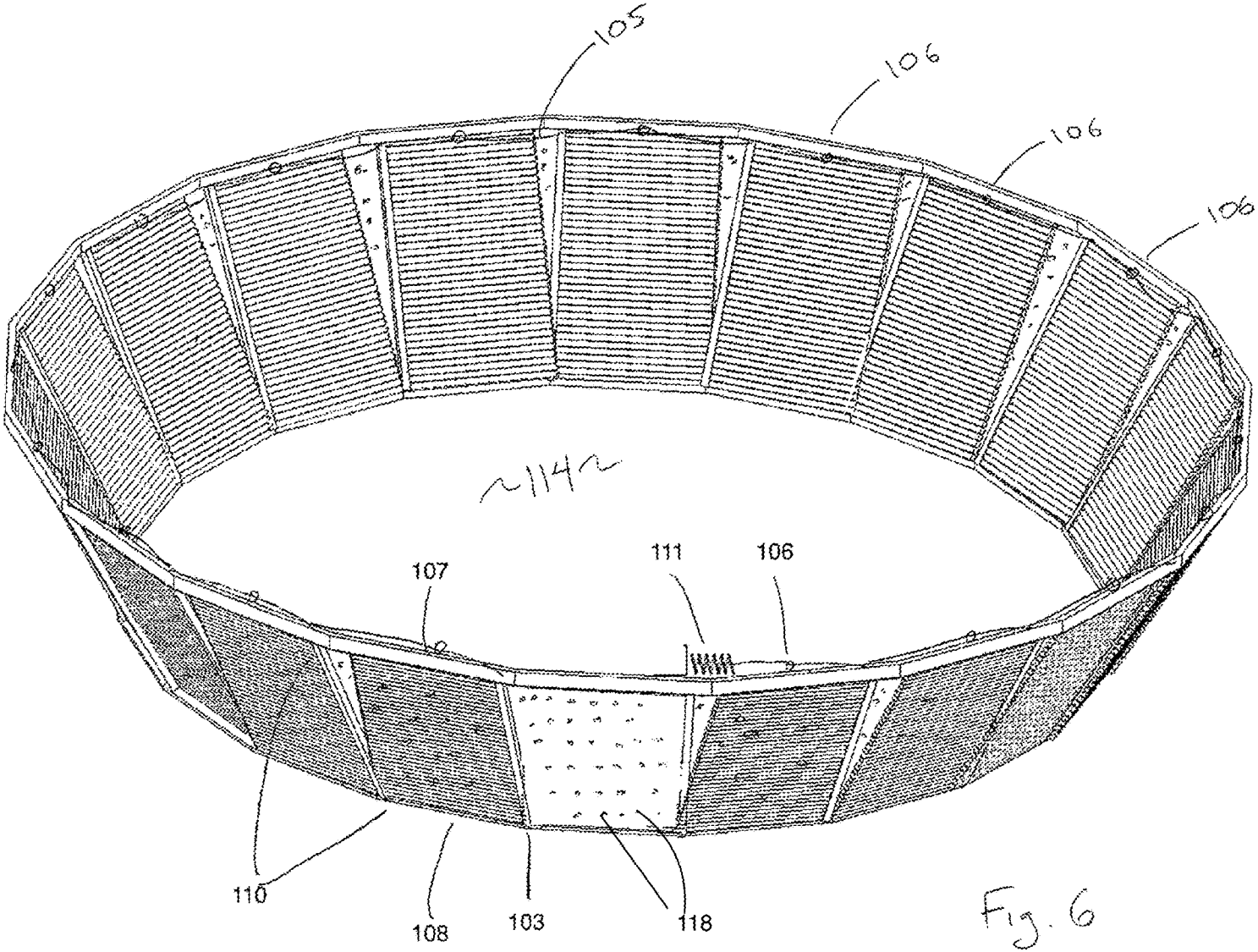
FIG. 6 is top perspective view of the apparatus with a plurality of hinges coupled together with their corresponding baffles disposed in the non-operative configuration.

A plurality of hinges 101 with their corresponding baffles 102 are assembled to a plurality of upper base rails 107 and lower base rails 108 shown in FIGS. 5 and 6. Upper and lower base rails 107, 108 collectively form the base 110. Each base rail 107 and 108 may be rigidly coupled to its corresponding stopper 103 and to the adjacent base rails 107, 108 at each opposing end of each base rail 107, 108 or may be flexibly coupled together by means of conventional flexible couplings (not shown). Therefore, continuing around the base rails 107, 108, the cable 105 is laid out concentrically in an in-and-out pattern in the depiction of FIGS. 5 and 6. The cable 105 lies over the stopper 103 and through the eyelet 104 on the hinge 101. In the illustrated embodiment of FIGS. 5 and 6 the upper end of hinge 101 is provided with eyelet 104 and upper base rail 107 is similarly provided with a base-mounted eyelet 106 through which cable 105 will be led. Alternatively, lower base rail 108 may have the eyelet 106 disposed thereon or extending thereform when eyelet 104 on hinge 101 is provided on the lower end of hinge 101. Then the cable 105 is led concentrically in FIGS. 5 and 6 by being threaded throughbase eyelet 106 and this pattern repeats toward the adjacent hinge 101 and baffle 102.

FIG. 5 illustrates an aspect of one embodiment. Baffles 102 are disposed in the operative configuration. Base 110 comprises a flexible material demonstrating some elasticity and contains perforations through the base to mitigate the collection of fluid on the base surface. Hinges 101 are fastened on the surface of base 110 either through adhesives, screws, or rivets. Central opening 114 exposes the pool of standing water (not shown) in the center of the toilet basin (not shown).

Baffles 102 will typically comprise a flexible material and vary in thickness and in length. Baffles 102 that are too long may cause more splash back due to the proximity of the baffles 102 to the upper rim of the toilet basin. Therefore, baffles 102 or varying lengths may typically be used where longer baffles 102 are disposed lower in the toilet basin and shorter baffles 102 are disposed higher in the toilet basin. Additionally, baffles 102 that are too thick may reduce the effectiveness of splash reduction. Therefore, the thickness of the baffles 102 would likely be smaller than the diameter of a typical urine stream.

During use, the urine stream will likely make contact with one of three different points: the baffles 102, the surface of the base 110, and the pool of standing water through the central opening 114. When the urine stream strikes the water, splash-back is mitigated through the interference of the baffles 102. As splash occurs, the baffles 102 interrupt the droplets' upward motion. When the urine stream strikes the surface of the base 110, the reflective droplets are again interrupted by the nearby baffles 102. Additionally, the perforations in the base 110 will mitigate the amount of the urine stream that makes contact at such an angle that produces droplets that would reflect outward. When the urine stream strikes a baffle 102, the urine stream is broken apart and a majority of the stream is fanned out. The fanning-out process produces the benefit of decelerating the urine stream as well as causing the urine stream to strike additional baffles 102 which will cause additional deceleration. Additionally, the amount of surface area by which outward-bound droplets form is reduced by the fact that the baffles 102 are cylindrically shaped including a rounded tip 116.

A larger density of hinges 101 may be used. This would reduce the amount of exposed base surface during the urinating process.

The position of the baffle 102 on each hinge 101 may be placed in a staggered formation to ease the transition to the non-operational configuration. A staggering of the baffles 102 may help the baffles 102 retract more compactly.

FIG. 6 illustrates an aspect of one embodiment. Baffles 102 are disposed in the non-operative configuration. A spring 111 is affixed to one end of the cable 105. The other end of the spring 111 is affixed to the base 110. The spring 111 provides a persistent tension pulling the hinges 101 and baffles 102 into the non-operative configuration. Perforations 118 provide a bore through base 110.

Figure 7:
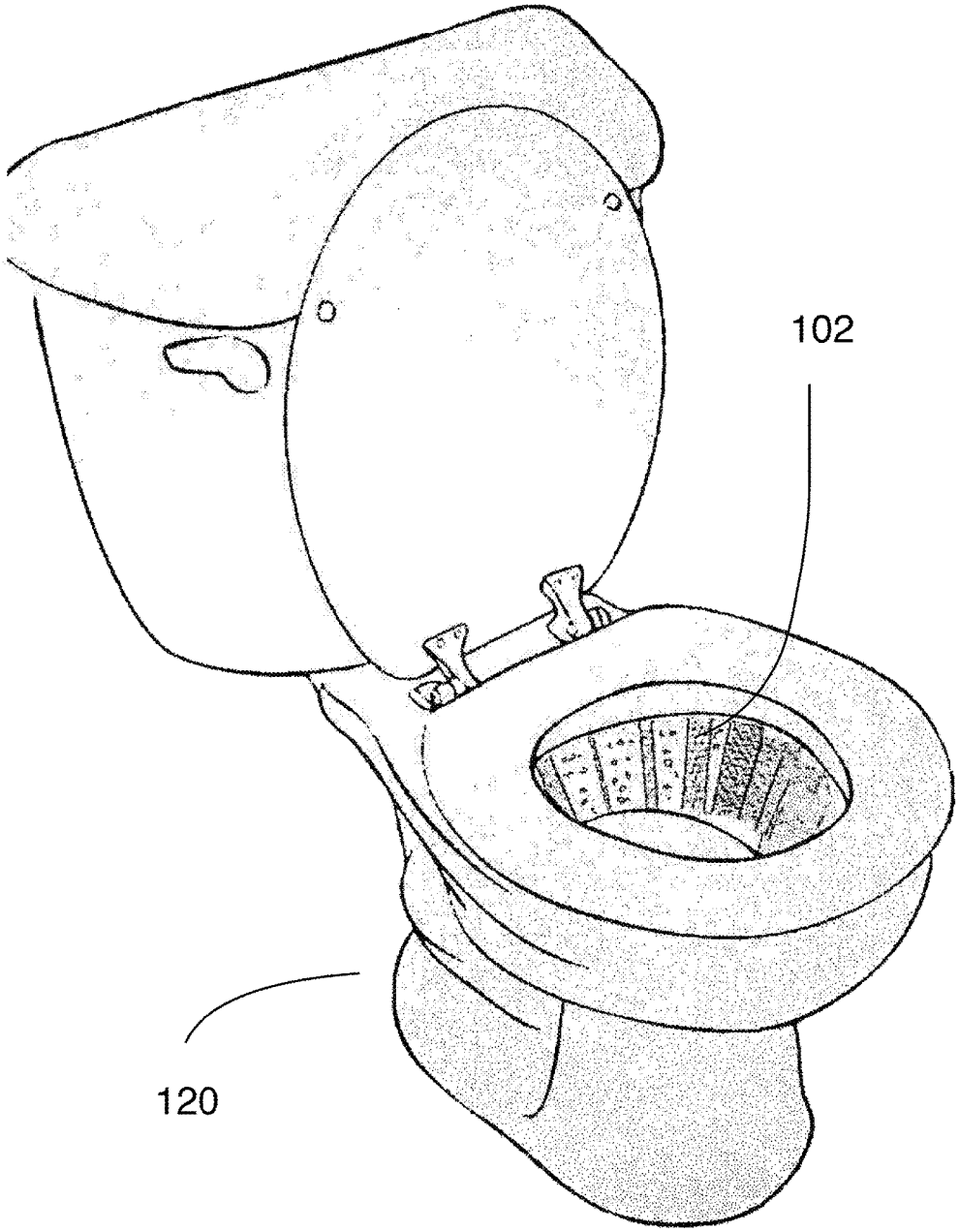
FIG. 7 is a top perspective view of the apparatus with a plurality of hinges coupled together with their corresponding baffles disposed in the operative configuration within a conventional floor toilet.

FIG. 7 illustrates an aspect of one embodiment. The apparatus is disposed within toilet 120 with baffles 102 disposed in the operative configuration.

Figure 8:
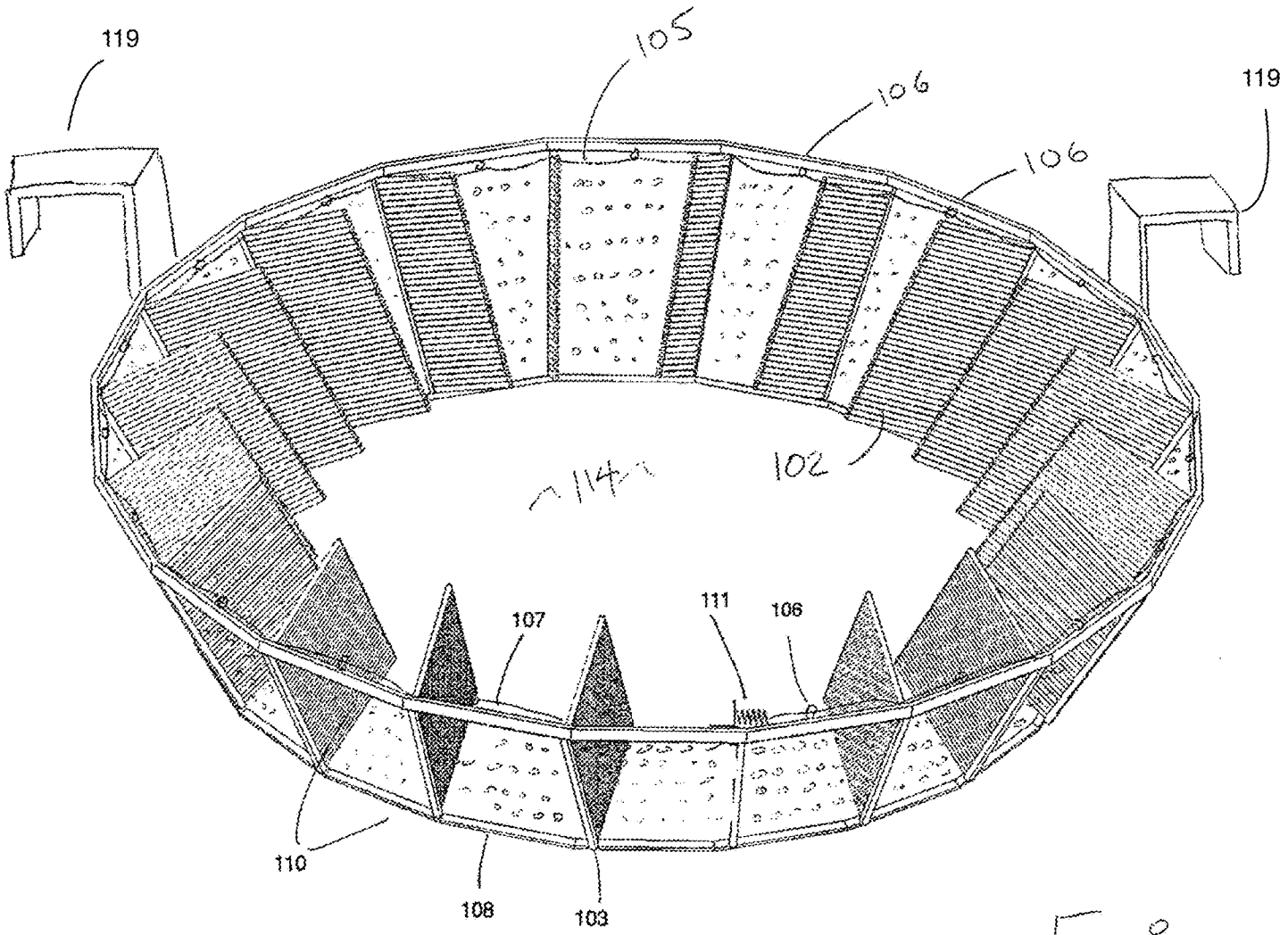
FIG. 8 is a top perspective view of the apparatus with hooks that suspend the apparatus within the toilet.

FIG. 8 illustrates an aspect of one embodiment. Hooks 119 provide a suspension mechanism for the apparatus when disposed within the toilet.

Figure 9:
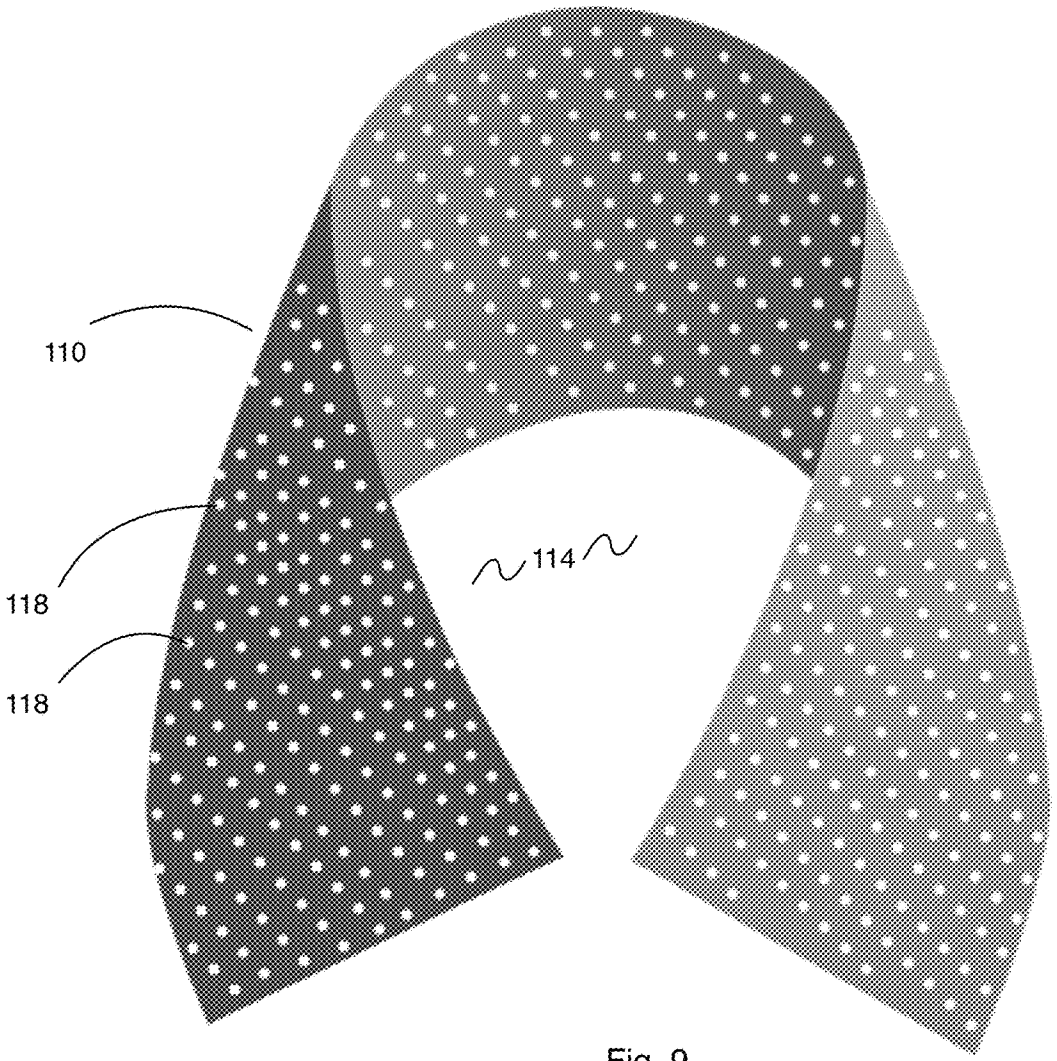
FIG. 9 is a top perspective view of the base without the upper or lower rails and without the hinges, stoppers, or baffles with the radial cut through the base.

FIG. 9 illustrates an aspect of one embodiment. Base 110 comprises of a flexible sheet material with a radial cut through base 110. Perforations 118 provide a bore through base 110. Central opening 114 exposes the pool of standing water within the toilet when base 110 is disposed along the inner-toilet surface.

Figure 10:
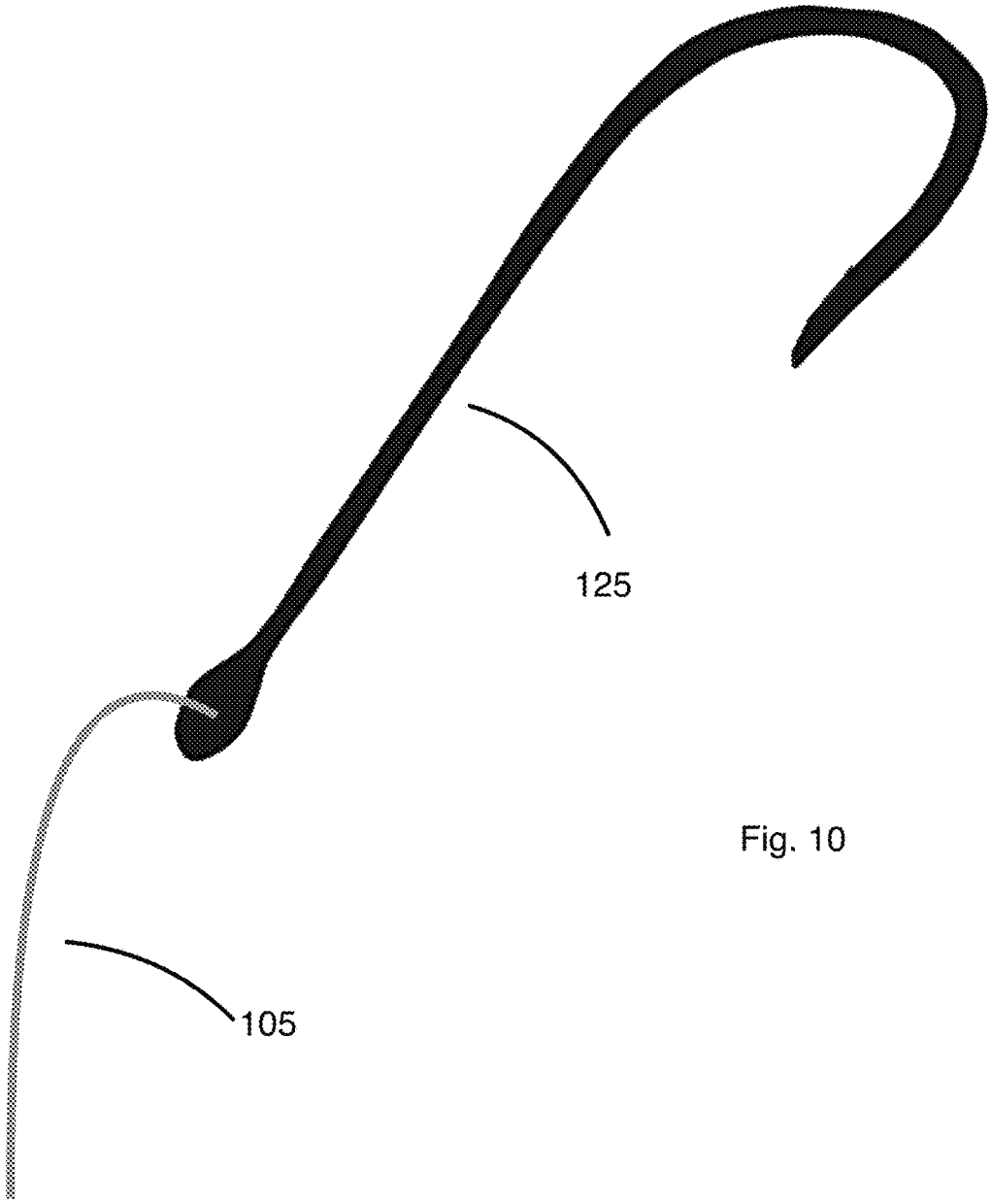
FIG. 10 is an isometric view of the hook that attaches to the toilet seat with the cable adhered to the hook.

FIG. 10 illustrates an aspect of one embodiment. Hook 125, comprising of a substantially rigid material, attaches to the toilet seat. Cable 105 is adhered to hook 125.

Figure 11:
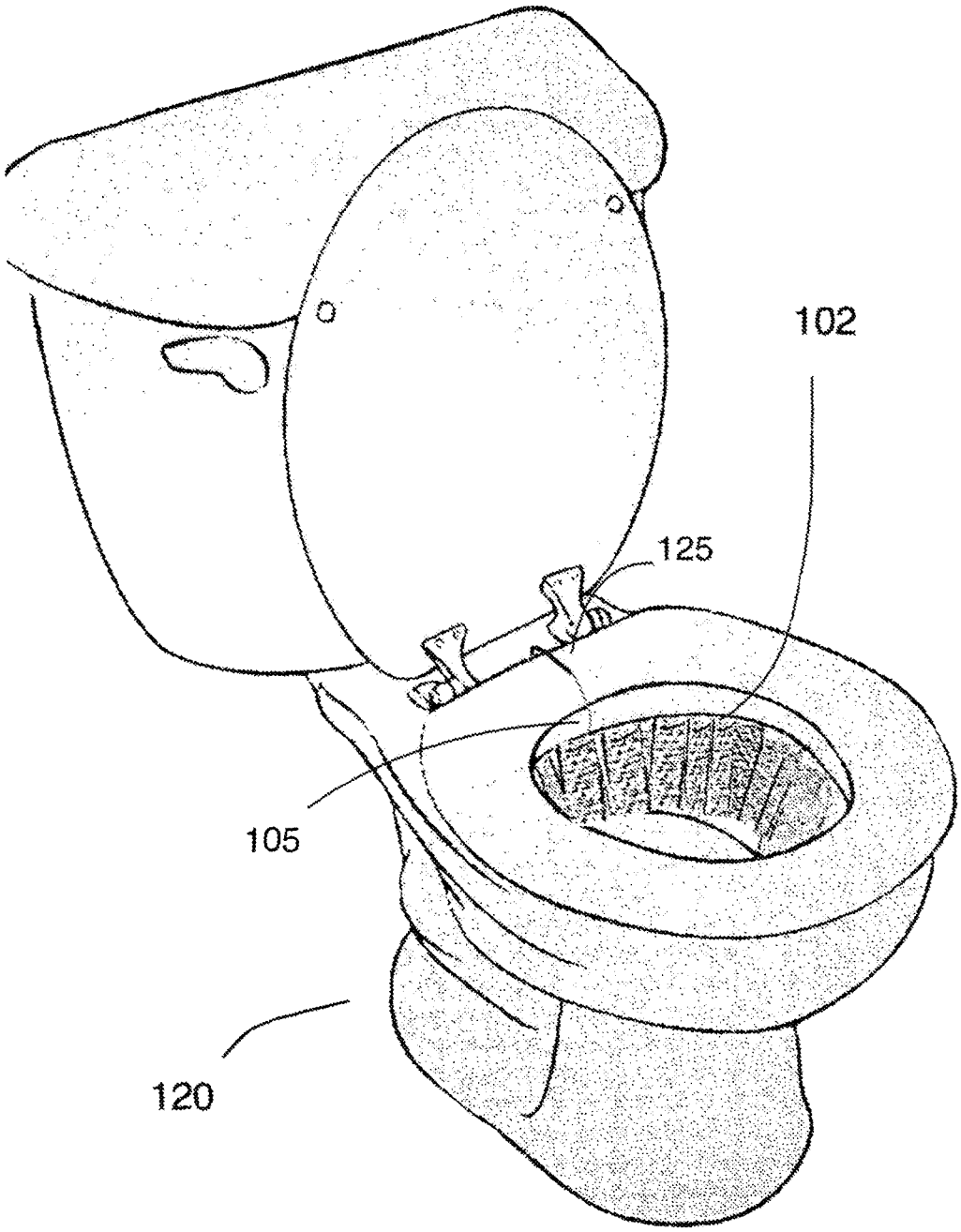
FIG. 11 is a top perspective view of the apparatus disposed within a conventional toilet with the hook attached to the toilet seat.

FIG. 11 illustrates an aspect of one embodiment. The apparatus is disposed within toilet 120 with baffles 102 in the non-operative configuration. Cable 105 is adhered to hook 125 and hook 125 is attached to the toilet seat of toilet 120. When the toilet seat is lifted, tension is provided in cable 105 which transitions baffles 102 from the non-operative configuration to the operative configuration shown in FIG. 7.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the embodiments.

We claim:

1. An apparatus for reducing splashing of urine in combination within a toilet having an inner-toilet surface, the apparatus comprising:

a base disposed on the inner-toilet surface which base defines a central opening;

a plurality of baffles extending from the base toward the central opening; and a corresponding plurality of hinges, disposed radially on the base, each one of the corresponding plurality of hinges coupled to one of the plurality of baffles, allowing each of the plurality of baffles to move into and out of an operative configuration relative to the inner-toilet surface.

2. The apparatus of claim 1, wherein a plurality of perforations defined through the base.

3. The apparatus of claim 2, where the base defines a reference plane and where each perforation comprises a bore through the base with a corresponding characterizing diameter and a corresponding axis angularly oriented at a pitch angle relative to the reference plane of the base, wherein the plurality of perforations comprise a plurality of subsets of perforations, each subset of perforations characterized by a different characterizing diameter and a different pitch angle of the perforations of the subset relative to the perforations of other ones of the plurality of subsets of perforations.

4. The apparatus of claim 1, wherein the base comprises a flexible pad.

5. The apparatus of claim 1, wherein the base includes a cross-sectional cut defined in the base extending from an outer edge of the base toward the central opening.

6. The apparatus of claim 1, wherein each of the plurality of baffles vary in length with a range of 1 inch to 5 inches, thickness with a range of 0.05 inches to 0.25 inches, and pitch, distance from one baffle to another, relative to one another with a range of 0.25 inches to 1 inch.

7. The apparatus of claim 1, further comprising a stopper, wherein the stopper is disposed adjacent each hinge.

8. The apparatus of claim 1, further comprising:

a plurality of stoppers, one stopper disposed beside each one of the plurality of hinges to limit rotation of one of the plurality of baffles about the corresponding hinge;

a cable attached to each one of the plurality of hinges; and a spring attached to one end of the cable.

9. The apparatus of claim 8, in combination with a toilet seat, further comprising a hook, wherein the hook attaches the unattached end of the cable to a toilet seat.

10. A method for operating a urine-splash mitigating device in a toilet, comprising:

providing a plurality of retractable baffles, each having a corresponding base with a hinge mounted on the corresponding base where the hinge is rotatable to dispose the corresponding baffles into and out of an operative configuration within the toilet;

positioning the plurality of baffles within the toilet where each corresponding base lies against the inner-toilet surface; and rotating the plurality of baffles into or out of the operative configuration.

11. The method of claim 10 where the toilet has a rim and where at least two of the bases are each coupled to two corresponding hooks and further comprising attaching the two corresponding hooks to the rim of the toilet.

12. The method of claim 10 where the corresponding hinge of each of the plurality of baffles is coupled to a cable and further comprising tensioning the cable to dispose the baffles in the operative configuration.

13. The method of claim 10 further comprising releasing tension in the cable to dispose the baffles in a non-operative configuration.

14. The method of claim 10 where the toilet has an inner-toilet surface and further comprising flushing the toilet to clean at least one of the corresponding bases and baffles as water flows down the inner-toilet surface and washes over the at least one of the corresponding bases and baffles.

15. The method of claim 10 further comprising urinating directly onto at least one of the plurality of baffles to redirect urine to mitigate splash back.

16. The method of claim 10 where the toilet has a standing pool of water and further comprising urinating directly onto the standing pool of water or onto at least one of the corresponding bases where the baffles intercept reflective droplets and prevent the droplets from splashing out of the toilet.

* * * * *